US005208564A

United States Patent [19]

Burns et al.

[11] Patent Number: 5,208,564

[45] Date of Patent: May 4, 1993

[54] ELECTRONIC PHASE SHIFTING CIRCUIT FOR USE IN A PHASED RADAR ANTENNA ARRAY

[75] Inventors: Richard W. Burns, Orange; Darren E. Atkinson, La Habra, both of Calif.

[73] Assignee: Hughes Aircraft Company, Los Angeles, Calif.

[21] Appl. No.: 812,243

[22] Filed: Dec. 19, 1991

[51] Int. Cl.[5] ..... H01P 1/185

[52] U.S. Cl. ..... 333/164; 333/161

[58] Field of Search ..... 333/156, 160, 161, 164, 333/138, 140, 33

[56] References Cited

U.S. PATENT DOCUMENTS

| | | | |
|---|---|---|---|
| 3,718,873 | 2/1973 | Garver | 333/164 |
| 3,982,214 | 9/1976 | Burns | 333/164 |
| 4,630,010 | 12/1986 | Yarman | 333/138 X |

FOREIGN PATENT DOCUMENTS

| | | | |
|---|---|---|---|
| 0165202 | 6/1989 | Japan | 333/164 |

*Primary Examiner*—Robert J. Pascal
*Assistant Examiner*—Seung Ham
*Attorney, Agent, or Firm*—Wanda K. Denson-Low

[57] ABSTRACT

A phase shifting circuit (10) which is especially suitable for use as a 180° phase bit for an antenna element in a phased radar antenna array includes a first transmission line (16) connected between first and second diodes (22,24), which are connected to input and output terminals (12,14) respectively. Second and third transmission lines (18,20) are connected in series with each other between the input and output terminals (12,14). A third diode (26) is connected between the junction (28) of the second and third transmission lines (18,20) and ground. The first transmission line (16) is less than one-quarter wavelength long at the operating frequency of the circuit (10), whereas the second and third transmission lines (18,20) are each approximately three-eighths wavelength long. Forward biasing the diodes (22,24,26) causes substantially all of the signal to propagate from the input terminal (12) to the output terminal (14) through the first transmission line (16), producing minimum phase shift. Reverse biasing the diodes (22,24,26) causes a major portion of the signal to propagate through the second and third transmission lines (18,20), producing maximum phase shift.

20 Claims, 4 Drawing Sheets

ELECTRONIC PHASE SHIFTING CIRCUIT FOR USE IN A PHASED RADAR ANTENNA ARRAY

BACKGROUND OF THE INVENTION

1. Field of the Invention

The present invention generally relates to electronic phase shifting circuits, and more specifically to a line-loop diode phase bit circuit suitable for use as a 180° phase bit for an antenna element in a phased radar antenna array.

2. Description of the Related Art

Phased array radar systems include a large number, typically thousands, of antenna elements, each of which radiates an electromagnetic signal that, by constructively adding in space, forms an electromagnetic beam which is caused to spatially sweep or scan by varying the phase of each of the individual antenna element signals. Since a separate phase shifting circuit is required for each antenna element, it is important in practical application to minimize the size, complexity and cost of these components.

Phase shifting circuits for radar systems are generally digital, including several delay elements or phase bits connected in cascade, each of which is electronically switchable to provide either a zero phase shift or a predetermined phase shift. A four bit phase shifting circuit, for example, includes four phase bits which provide phase shifts of 180°, 90°, 45° and 22.5° respectively. Switching the phase bits in the proper combinations enables the phase shifting circuit to produce a phase shift which is progressively variable in 22.5° increments from 0° to 337.5°.

As described in a textbook entitled "RADAR HANDBOOK Second Edition", by M. Skolnik, McGraw-Hill, 1990, pp. 7.63–7.67, diode phase bit circuits, to which the present invention relates, are conventionally based on a switched-line, hybrid-coupled or loaded-line configuration.

The switched-line phase bit circuit includes a pair of single-pole, double-throw switches for switching one of two lengths of transmission line into a circuit. This circuit generally requires four diodes. Phase shift is obtained by switching between one line which constitutes a reference path and a second line which provides a delay path.

The hybrid-coupled phase bit circuit includes a 3-decibel hybrid coupler with a pair of balanced diode switches connected to identical split arms of the hybrid. The hybrid-coupled bit is used extensively because it enables large phase shifts while using only two diodes.

The loaded-line phase-bit circuit includes a number of pairs of switched susceptances spaced at one-quarter wavelength intervals along a transmission line. Phase shift is obtained by switching the susceptances between an inductive and a capacitive state. Phase shift for this circuit is limited to about 45° for one pair of diodes.

Generally, the larger the phase shift required, the more difficult the phase bit circuit is to design. In order to reduce cost, the number of diodes used must be minimized. The switched-line phase bit circuit requires four diodes, and is limited in power handling capability since it requires small, low loss diodes in order to provide low insertion loss. The loaded-line phase bit is capable of high power operation, but is too large and bulky for many applications.

Phase shifting circuits may be fabricated at low cost using a microstrip construction and a thick film printing technique where the circuit metallization, capacitors and resistors are formed on an alumina substrate with multiple printing and firings. The 3-decibel "Lange" hybrid coupler (an interdigitated structure), which is the primary element in current hybrid-coupled phase bit circuits, is a complicated and expensive element to fabricate due to close line width tolerances, minimum line width, and inclusion of critical gaps and line separations. These constraints preclude the fabrication of Lange couplers using current thick film printing technology.

SUMMARY OF THE INVENTION

In accordance with the present invention, a line-loop phase bit circuit which is especially suitable for use as a 180° phase bit for an antenna element in a phased radar antenna array includes a first transmission line connected between an input terminal and an output terminal. First and second diodes are connected between the first transmission line and the input and output terminals respectively. Second and third transmission lines are connected in series with each other between the input and output terminals. A third diode is connected between the junction of the second and third transmission lines and ground.

The first transmission line is less than one-quarter wavelength long at the operating frequency of the circuit, whereas the second and third transmission lines are each approximately three-eighths wavelength long. Forward biasing the diodes causes substantially all of the signal to propagate from the input terminal to the output terminal through the first transmission line, producing minimum phase shift. Reverse biasing the diodes causes a major portion of the signal to propagate through the second and third transmission lines, producing maximum phase shift.

The present line-loop phase bit circuit is advantageous in that it does not require a 3-decibel hybrid, and has a power handling capability which is approximately twice that of a hybrid-coupled phase bit. It is capable of providing a wide range of phase shifts, and only three diodes are required for a phase shift of 180°.

The present phase bit circuit is small, occupying less space than a hybrid-coupled phase bit, and has a short electrical length which reduces line loss. A wide manufacturing tolerance on diode parameters is possible for fabrication using thick film printing since the phase shift is determined primarily by the transmission line lengths and impedance levels. The present circuit is broadband, capable of operation over a bandwidth of 20%–30%.

These and other features and advantages of the present invention will be apparent to those skilled in the art from the following detailed description, taken together with the accompanying drawings, in which like reference numerals refer to like parts.

DETAILED DESCRIPTION OF THE INVENTION

Figure 1:
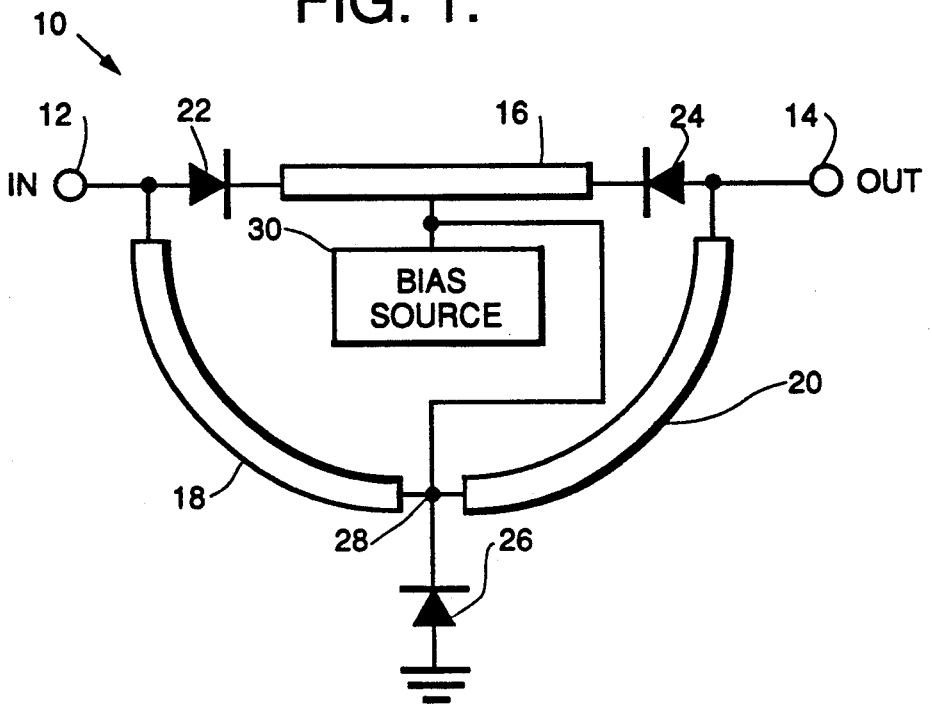
FIG. 1 is a simplified diagram illustrating a line-loop phase bit circuit embodying the present invention.

Referring to FIG. 1 of the drawing, a line-loop phase bit circuit embodying the present invention is generally designated as 10, and includes an input terminal 12 and an output terminal 14. An input signal IN, such as an electromagnetic pulse signal for transmission by a phased array radar antenna element (not shown), is applied between the input terminal 12 and ground. The circuit 10 produces an output signal OUT which is delayed in time or shifted in phase relative to the input signal IN, and applied through appropriate amplifier and other circuitry (not shown) to the antenna element. It will be understood that the term "ground" refers to an electrical potential or common circuit plane to which the input and output signals are referenced, and is not necessarily earth ground or zero voltage.

A first transmission line 16 is connected in series with first and second diodes 22 and 24 between the input and output terminals 12 and 14. Second and third transmission lines 18 and 20 are connected in series with each other between the input and output terminals 12 and 14 to constitute a line-loop. A third diode 26 has a cathode connected to a junction 28 between the second and third transmission lines 18 and 20, and an anode connected to ground. A bias voltage source 30 is connected to the cathodes of the diodes 22 and 24 through the transmission line 16, and to the cathode of the diode 26 through the junction 28.

The diodes 22, 24 and 26 may be forward biased by the source 30 to provide a first or minimum predetermined amount of phase shift through the circuit 10, or reverse biased to provide a second or maximum predetermined amount of phase shift. The first transmission line 16 preferably has a length of less than approximately one-quarter of the wavelength of the input signal IN, whereas the transmission lines 18 and 20 each have a length of approximately three-eighths of the wavelength of the signal IN.

The bias voltage source 30 forward biases the diodes 22, 24 and 26 by applying a first bias voltage to the cathodes thereof which is negative relative to ground. In this state, the diodes 22 and 24 present low resistance to the input signal IN, such that substantially all of the signal IN propagates from the input terminal 12 through the first transmission line 16 to the output terminal 14 to constitute the output signal OUT. Since the length of the first transmission line 16 is short (less than one-quarter wavelength), the signal propagating therethrough experiences minimum time delay or phase shift.

In the forward biased state, the diode 26 presents low resistance between the junction 28 and ground. The junction 28, and thereby the lower ends of the second and third transmission lines 18 and 20, are essentially grounded such that substantially no portion of the input signal IN propagates from the input terminal 12 through the second and third transmission lines 18 and 20 to the output terminal 14.

The bias voltage source 30 reverse biases the diodes 22, 24 and 26 by applying a second bias voltage to the cathodes thereof which is positive relative to ground. The first and second diodes 22 and 24 present high capacitive reactance to the input signal IN, such that only a small portion thereof propagates from the input terminal 12 through the first transmission line 16 to the output terminal 14. The third diode 26 in the reverse biased state presents high reactance, substantially an open circuit, between the junction 28 and ground. Thus, the major portion of the input signal IN propagates from the input terminal 12 through the second and third transmission lines 18 and 20 in series to the output terminal 14. Since the combined length of the transmission lines 18 and 20 is approximately three-quarter wavelength, the signal propagating therethrough experiences maximum time delay or phase shift.

The input signal IN splits into two branches or portions in the reverse biased or maximum phase shift state as described above which recombine at the output terminal 14 to constitute the output signal OUT. The total phase shift is a function of the lengths and impedance levels of the transmission lines 16, 18 and 20, and also of the capacitive reactance of the first and second diodes 22 and 24. When the capacitive reactance of diodes 22 and 24 is high, almost all the signal goes along transmission lines 18 and 20 and very little goes through transmission line 16. When the normalized capacitive reactance of diodes 22 and 24 is relatively low (about 1.0), the signal IN splits nearly equally between the two paths at input terminal 12 and adds vectorially at output terminal 14 to constitute the output signal OUT.

The circuit 10 is capable of providing a differential phase shift (phase difference between forward and reverse biased states) within a wide range of values, including 180°, by selection of the component values.

Figure 2:
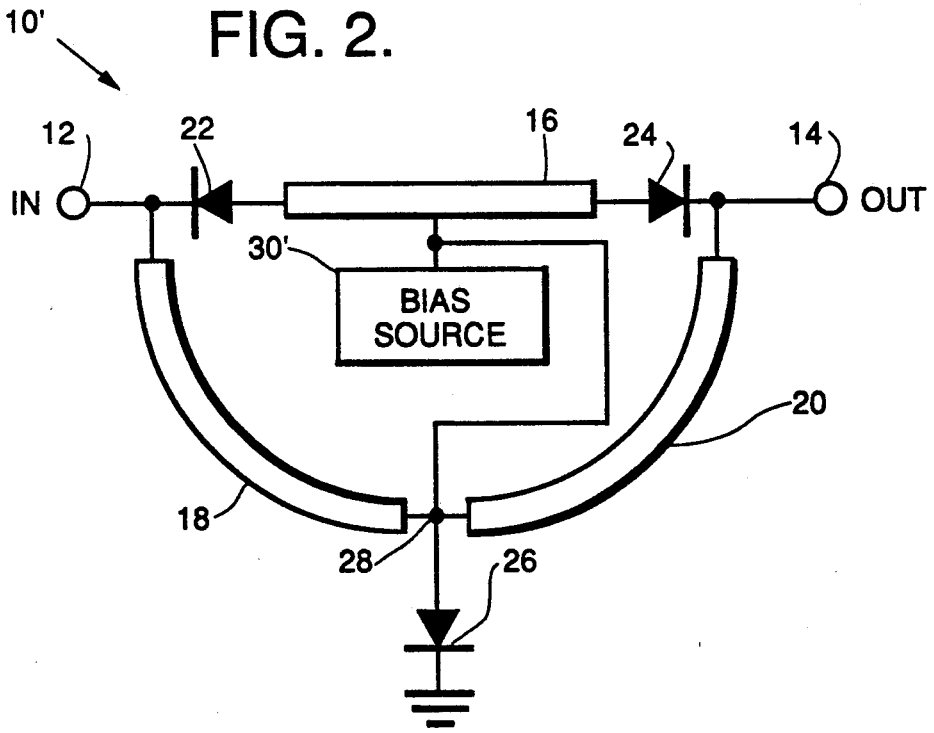
FIG. 2 is similar to FIG. 1, but shows an alternative embodiment.

FIG. 2 illustrates a modified phase bit circuit 10′ which differs from the circuit 10 in that the polarities of the diodes 22, 24 and 26 are reversed. A modified bias source 30′ also has its polarities reversed so as to produce a positive bias voltage to forward bias the diodes 22, 24 and 26, and a negative bias voltage to reverse bias the diodes.

The phase shifts in the forward and reverse biased states are also influenced to a smaller extent by the various ohmic resistances and the inductive and capacitive reactances in the circuit 10 or 10′, all of which must be taken into account in designing for a practical application. In addition, the internal impedances of the circuit 10 or 10′ must be selected such that the input and output impedances are matched to the external circuitry (not shown) connected to the input and output terminals 12 and 14. The desired input and output impedances are typically 50 ohms. If an acceptable impedance match cannot be obtained by selection of the internal impedances in the o circuit 10 or 10′, suitable impedance matching transformers (not shown) may be provided at the input and output terminals 12 and 14 to provide proper matching.

Figure 3:
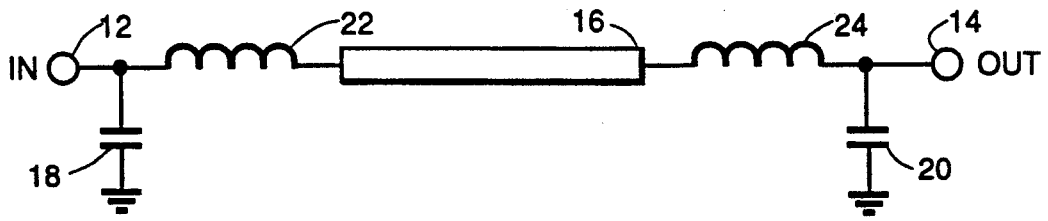
FIG. 3 is a simplified equivalent circuit diagram illustrating the present phase bit circuit in a forward biased state which provides minimum phase shift.

FIG. 3 illustrates an equivalent circuit corresponding to the circuit 10 or 10′ in the forward biased state. The diodes 22, 24 and 26 have low values of inductance due to the physical wiring thereof, whereas the second and third transmission lines 18 and 20 reflect capacitances across terminals 12 and 14 since they are essentially connected to ground through the junction 28 and diode 26.

Figure 4:
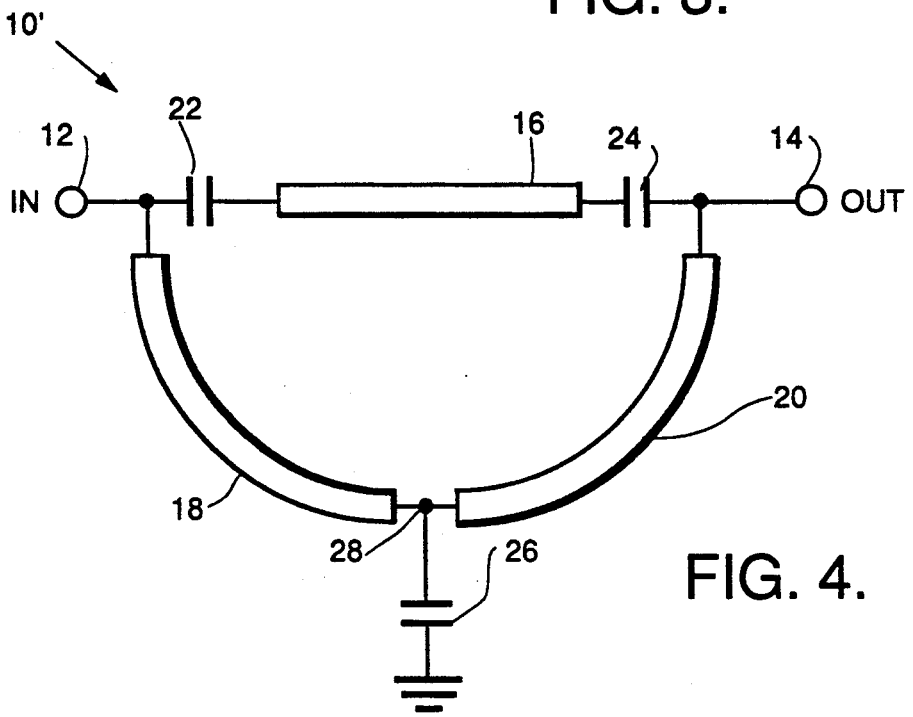
FIG. 4 is similar to FIG. 3, but illustrates the phase bit circuit in a reverse biased state which provides maximum phase shift.

An equivalent circuit corresponding to the circuit 10 or 10' in the reverse biased state is illustrated in FIG. 4. The diodes 22, 24 and 26 have small values of capacitance due to the space charge across their reverse biased junctions. Preferably, the diodes 22, 24 and 26 are heavily doped "P" type-intrinsic-heavily doped "N" type (PIN) diodes, which eliminate the variation of capacitance with reverse bias voltage at microwave frequencies which is inherent in other types of diodes.

Figure 5:
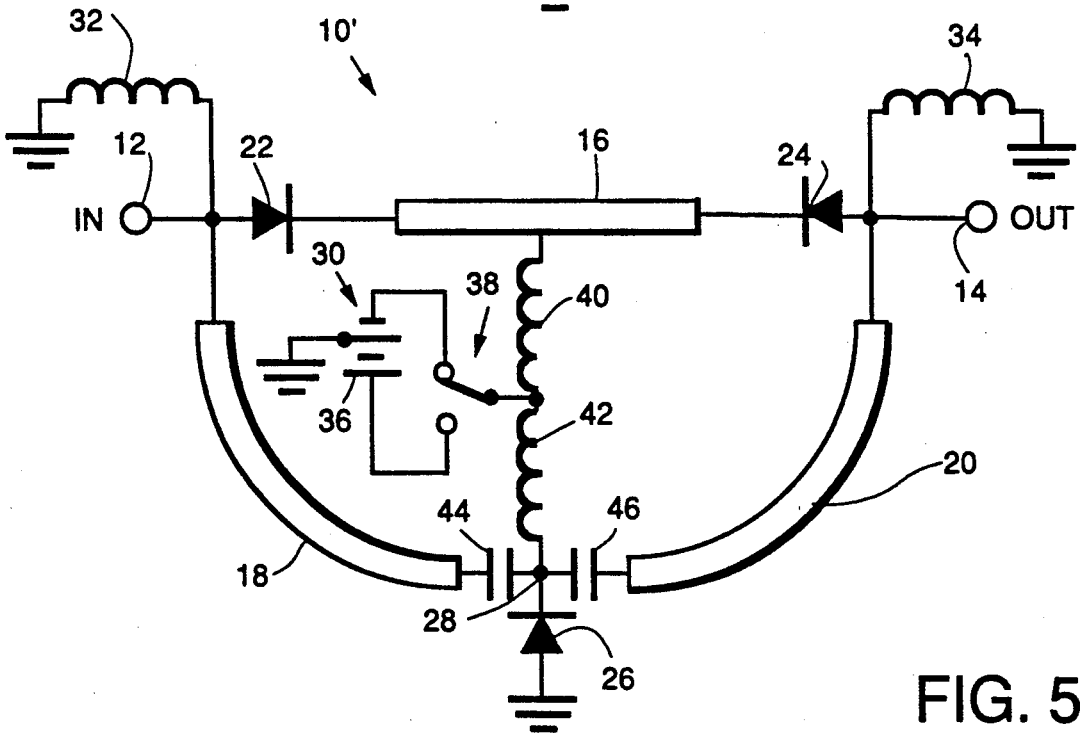
FIG. 5 is a diagram illustrating the phase bit circuit of FIG. 1 in more detail.

The present phase bit circuit 10 is further illustrated in FIG. 5, which shows the biasing arrangement in greater detail. In addition to the components illustrated in FIG. 1, the circuit includes radio frequency (RF) chokes 32 and 34 connected between the input and output terminals 12 and 14 respectively and ground. The chokes 32 and 34 are designed to have negligible ohmic resistance, and maintain the terminals 12 and 14 at direct current (DC) ground. The inductive reactances of the chokes 32 and 34 at the operating signal frequency are selected to be very high, such that the chokes 32 and 34 present an essentially open circuit to the signals IN and OUT.

The bias voltage source 30 is illustrated as including a direct current source which is symbolically represented by a battery 36 and produces a first bias voltage on the order of −0.75 V at its upper end for forward biasing the diodes 22, 24 and 26, and a second bias voltage on the order of +50 V at its lower end for reverse biasing the diodes 22, 24 and 26. A switching unit which is symbolically represented by a single-throw, double-pole switch 38 is provided for selectively connecting the upper or lower end of the battery 36 to the diodes. In an actual phased array radar, the switching unit will include solid state switches (not shown) which switch the corresponding phase bits of each antenna element simultaneously.

RF chokes 40 and 42 which provide the same function as the chokes 32 and 34 are connected between the output of the switch 38, and the transmission line 16 and junction 28 respectively. Capacitors 44 and 46 are connected between the junction 28, and the transmission lines 18 and 20 respectively.

The anodes of the diodes 22 and 24 are connected to DC ground through the chokes 32 and 34. The cathodes of the diodes 22 and 24 are constantly connected to the negative or positive end of the battery 36 at DC through the choke 40 and switch 38. The cathode of the diode 26 is constantly connected to the negative or positive end of the battery 36 at DC through the choke 42 and switch 38. The chokes 40 and 42 prevent RF signal propagation between the transmission line 16, battery 36 and junction 28.

The capacitors 44 and 46 present an open circuit at DC between the junction 28 and the input and output terminals 12 and 14 respectively. The capacitive reactance of the capacitors 44 and 46 at the operating signal frequency is selected to be small, so that the input signal IN propagates through the capacitors 44 and 46 with negligible loss.

In summary, the RF chokes 32, 34, 44 and 46 are provided to pass DC and block signals at the operating frequency, whereas the capacitors 44 and 46 are provided to block DC and pass signals at the operating frequency.

EXAMPLE

Figure 6:
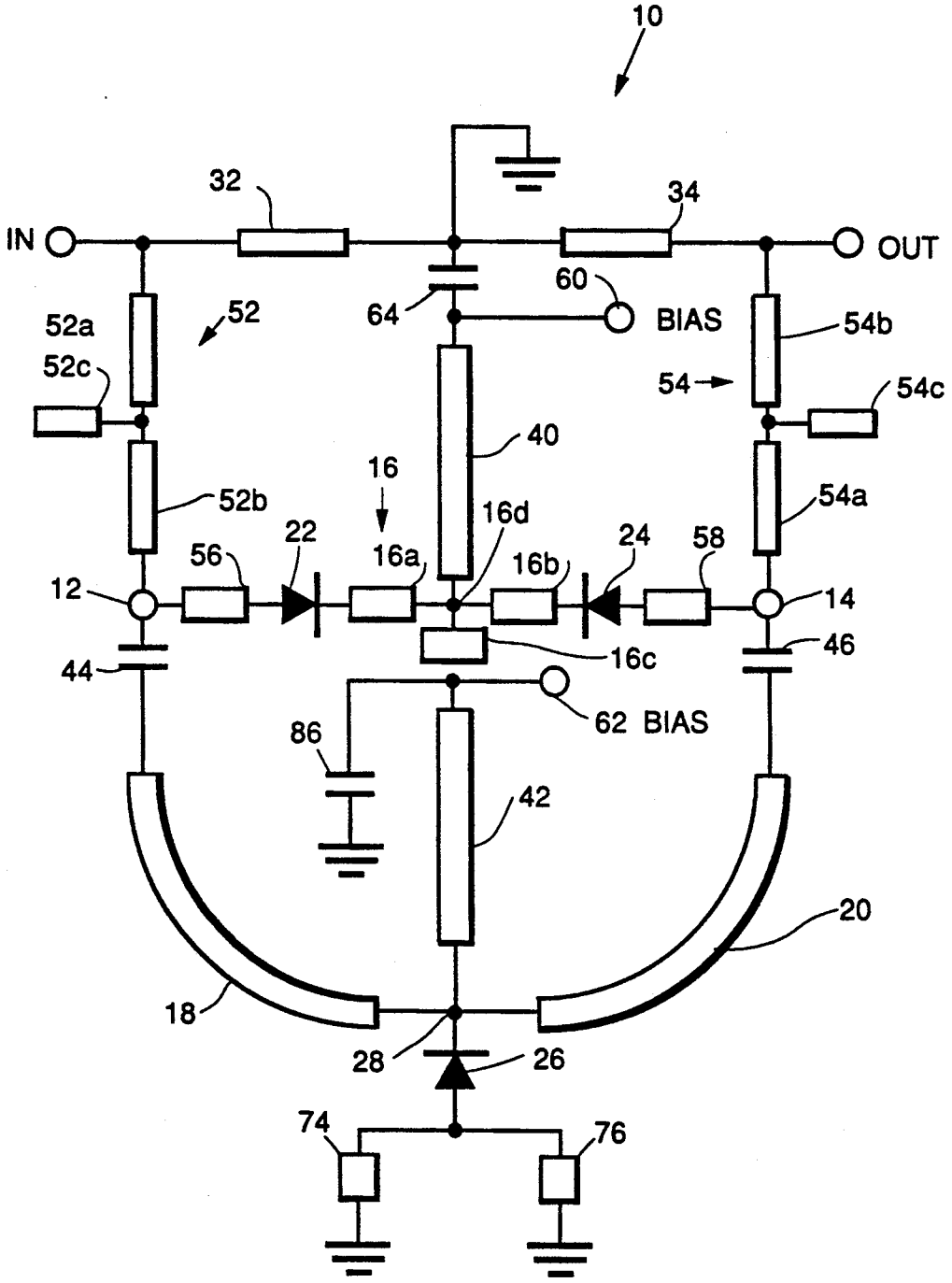
FIG. 6 is a more detailed diagram of the phase bit circuit of FIG. 1, showing biasing, impedance matching and ground returns for DC.

A device corresponding to the circuit 10 was fabricated on an insulating substrate using thick film printing technology as illustrated by the equivalent circuit in FIG. 6, and tested to demonstrate the operation of the present invention. Corresponding elements are designated by the same reference numerals used in FIGS. 1 and 5.

The transmission lines 16, 18 and 20, and the inductors 32, 34, 40 and 42 were fabricated on an alumina substrate by thick film printing in the form of microstrip lines. The input signal IN is inputted to the input terminal 12 through a microstrip impedance matching transformer 52 including series segments **52*a* and 52*b*, and an open shunt segment 52*c* connected at one end to the junction of the segments 52*a* and 52*b***.

The transformer 52 has a low-pass configuration. The output signal OUT is outputted from the circuit 10 through an impedance matching transformer 54 which is similar to the transformer 52, including series segments **54*a* and 54*b*, and an open shunt segment 54*c*. The anodes of the diodes 22 and 24 are connected to the segments 52*b* and 54*a* of the transformers 52 and 54 by wire bonds 56 and 58** respectively.

The first transmission line 16 is illustrated as including a first series segment **16*a*, a second series segment 16*b*, and an open shunt segment 16*c* having an end connected to a junction 16*d* of the segments 16*a* and 16*b*. The segments 16*a*, 16*b* and 16*c* have a low pass configuration. It is further within the scope of the invention, although not specifically illustrated, to ground the opposite end of the segment 16*c* to provide a high pass configuration. Additional segments or combinations of segments may also be provided to adjust the effective length and impedance of the transmission line 16** to desired values.

The bias voltage source 30 (not shown in FIG. 6) is connected to electrically conductive bias pads 60 and 62. The bias pad 60 is connected to the junction **16*d* of the first transmission line 16 through the inductor 40, and to ground through a thick film capacitor 64. The inductors 32 and 34 are connected between the segments 52*b* and 54*a* of the impedance matching transformers 52 and 54** respectively, and ground.

The capacitors 44 and 46 are formed by thick film printing, and provided between the second and third transmission lines 18 and 20 and the input and output terminals 12 and 14 respectively. It will be understood that this arrangement is electrically equivalent to the connection of the capacitors 44 and 46 between the transmission lines 18 and 20 and the junction 28 as shown in FIGS. 1 and 5.

The anode of the diode 26 is connected to ground through wire bonds 74 and 76. A thick film capacitor 86 is connected from the junction of the bias pad 62 and inductor 42 to ground. The lengths and impedances of the various microstrip lines are tabulated in the following table, in which the line lengths are expressed as multiples of one wavelength λ at the operating signal frequency.

TABLE

| Line No. | Length (xλ) | Impedance (ohms) |
|---|---|---|
| 32, 34 | 0.28 | 69 |
| 52a, 54b | 0.077 | 36 |
| 52b, 54a | 0.091 | 59 |
| 52c, 54c | 0.03 | 60 |
| 56, 58 | 0.01 | 69 |
| 16a, 16b | 0.026 | 56 |
| 16c | 0.08 | 30 |
| 40 | 0.225 | 64 |
| 18, 20 | 0.31 | 37 |

TABLE-continued

| Line No. | Length (xλ) | Impedance (ohms) |
|---|---|---|
| 42 | 0.247 | 69 |

The capacitors 44, 46, 64 and 86 each have a capacitance of 10 picofarads. The capacitances of the PIN diodes 22, 24 and 26 in the reverse biased states are 0.35 picofarad. The wire bonds 56 and 58 each have an inductance of 0.18 nanohenry, whereas the wire bonds 74 and 76 together have an inductance of 0.15 nanohenry. The input and output impedances of the circuit 10 including the impedance matching transformers 52 and 54 are each approximately 50 ohms.

Figure 7:
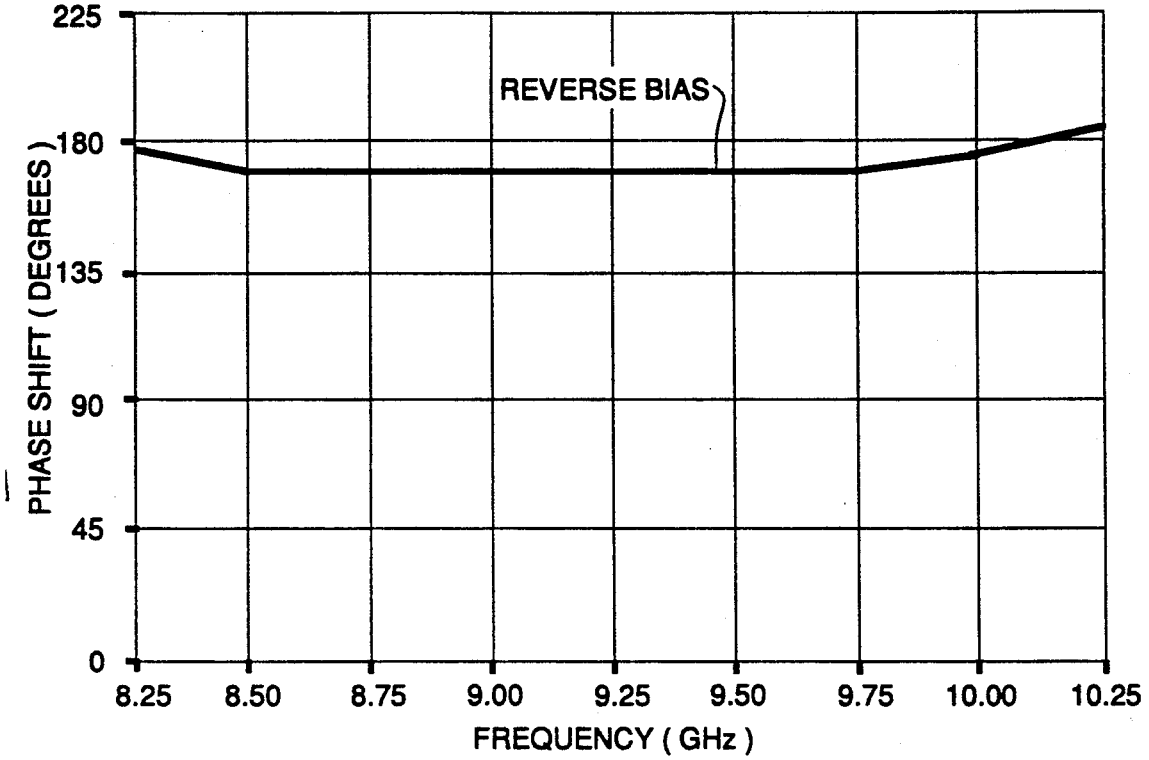
FIG. 7 is a graph illustrating the relative phase shift of the circuit of FIG. 6 as a function of frequency.
Figure 8:
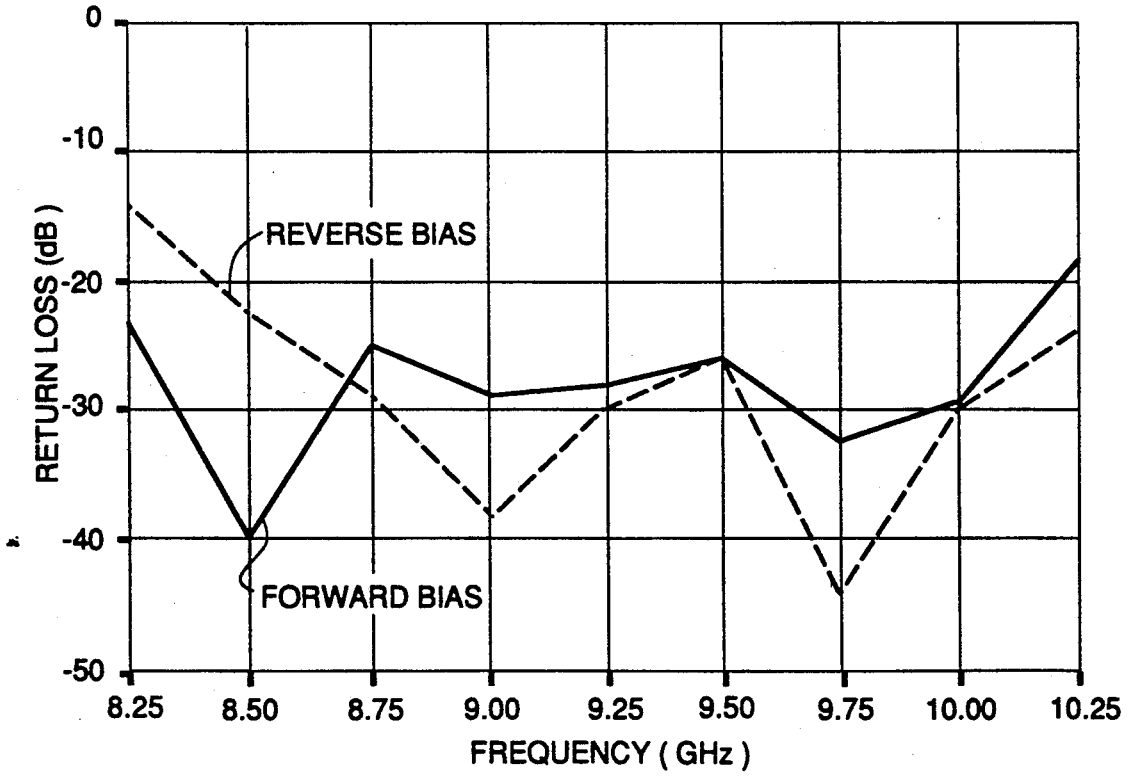
FIG. 8 is a graph illustrating the return loss of the phase bit circuit of FIG. 6 as a function of frequency.

FIGS. 7 and 8 illustrate the measured performance of the circuit 10 at X-band frequencies between 8.25 and 10.25 gigahertz. As shown in FIG. 7, the differential phase shift remained within about 15 degrees of 180° over the test bandwidth of approximately 20%. The phase shift in the forward biased state was approximately 279°, whereas the phase shift in the reverse biased state was approximately 474°.

FIG. 8 illustrates the return loss of the circuit 10 in the forward and reverse biased states. The return loss in both states was less than approximately −20 decibels over the test bandwidth.

While several illustrative embodiments of the invention have been shown and described, numerous variations and alternate embodiments will occur to those skilled in the art, without departing from the spirit and scope of the invention. Accordingly, it is intended that the present invention not be limited solely to the specifically described illustrative embodiments. Various modifications are contemplated and can be made without departing from the spirit and scope of the invention as defined by the appended claims.

We claim:

1. A phase bit circuit for receiving an input signal and producing an output signal which is selectively shifted in phase by a first predetermined amount or a second predetermined amount relative to the input signal, comprising;

input terminal means for inputting the input signal;

output terminal means for outputting the output signal;

first transmission line means coupled between the input and output terminal means;

a first diode coupled between the first transmission line means and the input terminal means;

a second diode coupled between the first transmission line means and the output terminal means;

second and third transmission line means connected in series with each other between the input and output terminal means, the second and third transmission line means defining a junction therebetween;

a third diode coupled between said junction of the second and third transmission line means and ground; and biasing means coupled to the first, second and third diodes for selectively forward biasing the first, second and third diodes to cause substantially all of the input signal to propagate from the input terminal means through the first transmission line means to the output terminal means to constitute the output signal which is shifted in phase relative to the input signal by the first predetermined amount; or reverse biasing the first, second and third diodes to cause a first portion of the input signal to propagate from the input terminal means through the first transmission line means to the output terminal means and a second portion of the input signal to propagate from the input terminal means through the second and third transmission line means to the output terminal means, said first and second portions of the input signal combining at the output terminal means to constitute the output signal which is phase shifted in phase relative to the input signal by the second predetermined amount.

2. A circuit as in claim 1, in which the first, second and third transmission line means have first, second and third lengths respectively, the sum of the second and third lengths being larger than the first length such that the second predetermined amount of phase shift is larger than the first predetermined amount of phase shift.

3. A circuit as in claim 2, in which the first, second and third lengths are selected such that the second predetermined amount of phase shift is approximately 180° larger than the first predetermined amount of phase shift.

4. A circuit as in claim 2, in which:

the input signal has a predetermined wavelength;

the first length is less than approximately one-quarter of the predetermined wavelength; and the second and third lengths are each approximately three-eighths of the predetermined wavelength.

5. A circuit as in claim 1, in which the first, second and third diodes are heavily doped "P" type-intrinsic-heavily doped "N" type (PIN) diodes.

6. A circuit as in claim 1, in which the biasing means comprises voltage source means for selectively applying a first bias voltage to the first and second diodes through the first transmission line means and to the third diode through said junction of the second and third transmission line means causing the first, second and third diodes to be forward biased; or applying a second bias voltage to the first and second diodes through the first transmission line means and to the third diode through said junction of the second and third transmission line means causing the first, second and third diodes to be reverse biased.

7. A circuit as in claim 6, in which:

the first transmission line means comprises first and second transmission line segments connected in series with each other between the input and output terminal means, the first and second transmission line segments defining a junction therebetween; and the voltage source means is connected in circuit to selectively apply the first bias voltage or the second bias voltage to said junction of the first and second transmission line segments.

8. A circuit as in claim 7, in which the biasing means further comprises:

first radio frequency choke means coupled between the voltage source means and said junction of the first and second transmission line segments; and second radio frequency choke means coupled between the voltage source means and said junction of the second and third transmission line means.

9. A circuit as in claim 6, in which the biasing means further comprises:

first radio frequency choke means coupled between the input terminal means and ground; and second radio frequency choke means coupled between the output terminal means and ground.

10. A circuit as in claim 6, in which the biasing means further comprises:

first capacitor means connected in series circuit with the second transmission line means between the input terminal means and the third diode; and second capacitor means connected in series with the third transmission line means between the output terminal means and the third diode.

11. A circuit as in claim 6, in which:

the first, second and third diodes each have cathodes and anodes; and the voltage source means is connected in circuit to selectively apply the first bias voltage or the second bias voltage to the cathodes of the first, second and third diodes.

12. A circuit as in claim 6, in which:

the first, second and third diodes each have cathodes and anodes; and the voltage source means is connected in circuit to selectively apply the first bias voltage or the second bias voltage to the anodes of the first, second and third diodes.

13. A circuit as in claim 1, further comprising an electrically insulating substrate, the input and output terminal means and first, second and third diodes being mounted on the substrate, the first, second and third transmission line means comprising first, second and third microstrip lines respectively formed on the substrate.

14. A phase bit circuit, comprising:

an input terminal;

an output terminal;

first transmission line means coupled between the input and output terminal means;

a first diode coupled between the first transmission line means and the input terminal means;

a second diode coupled between the first transmission line means and the output terminal means;

second and third transmission line means connected in series with each other between the input and output terminal means, the second and third transmission line means defining a junction therebetween;

a third diode coupled between said junction of the second and third transmission line means and ground; and circuit means coupled to the first, second and third diodes for selectively applying a first bias voltage for forward biasing the first, second and third diodes; or a second bias voltage for reverse biasing the first, second and third diodes.

15. A circuit as in claim 14, in which the first, second and third transmission line means have first, second and third lengths respectively, the sum of the second and third lengths being larger than the first length such that the second predetermined amount of phase shift is larger than the first predetermined amount of phase shift.

16. A circuit as in claim 14, in which:

the input signal has a predetermined wavelength;

the first length is less than approximately one-quarter of the predetermined wavelength; and the second and third lengths are each approximately three-eighths of the predetermined wavelength.

17. A circuit as in claim 14, in which the first, second and third diodes are heavily doped "P" type-intrinsic-heavily doped "N" type (PIN) diodes.

18. A circuit as in claim 14, in which the circuit means comprises voltage source means for selectively applying the first bias voltage to the first and second diodes through the first transmission line means and to the third diode through said junction of the second and third transmission line means causing the first, second and third diodes to be forward biased; or applying the second bias voltage to the first and second diodes through the first transmission line means and to the third diode through said junction of the second and third transmission line means causing the first, second and third diodes to be reverse biased.

19. A circuit as in claim 18, in which:

the first transmission line means comprises first and second transmission line segments connected in series with each other between the input and output terminal means, the first and second transmission line segments defining a junction therebetween; and the voltage source means is connected in circuit to selectively apply the first bias voltage or the second bias voltage to said junction of the first and second transmission line segments.

20. A circuit as in claim 19, in which the circuit means further comprises:

first radio frequency choke means coupled between the voltage source means and said junction of the first and second transmission line segments;

second radio frequency choke means coupled between the voltage source means and said junction of the second and third transmission line means;

first radio frequency choke means coupled between the input terminal means and ground;

second radio frequency choke means coupled between the output terminal means and ground.

* * * * *